US006301921B1

(12) United States Patent
Francesco

(10) Patent No.: US 6,301,921 B1
(45) Date of Patent: Oct. 16, 2001

(54) GARBAGE COLLECTION SYSTEM

(76) Inventor: Sampietro Francesco, Via ai Ronchi 24, 6943 Vezia (CH)

( * ) Notice: Subject to any disclaimer, the term of this patent is extended or adjusted under 35 U.S.C. 154(b) by 0 days.

(21) Appl. No.: 09/611,333

(22) Filed: Jul. 6, 2000

(30) Foreign Application Priority Data

Mar. 15, 2000 (CH) ..... 495/00

(51) Int. Cl.[7] ..... F25D 25/04
(52) U.S. Cl. ..... 62/380; 62/63
(58) Field of Search ..... 62/378, 380, 63, 62/64

(56) References Cited

U.S. PATENT DOCUMENTS 4,215,966 * 8/1980 Cooper ..... 414/173
4,266,900 * 5/1981 Rynyk ..... 414/285
5,513,807 * 5/1996 Stricker ..... 241/23

FOREIGN PATENT DOCUMENTS

WO-9961349-A* 12/1999 (WO) .

* cited by examiner

*Primary Examiner*—William Doerrler
(74) *Attorney, Agent, or Firm*—Young & Thompson

(57) ABSTRACT

A system (1) for collecting garbage includes one or more openings (2*e*) for depositing garbage (10*n*, 10) into one or more containers (3', 3", 3''', 3$^{1v}$), and a device (5) which can be actuated to deposit the waiting garbage (10, 10*n*) into a storage area or send it outside.

12 Claims, 2 Drawing Sheets

GARBAGE COLLECTION SYSTEM

BODY OF THE INVENTION

This invention relates to the technological field of systems which are used in the city to collect recyclable or non-recyclable garbage, for the purpose of removing it and afterwards sending it to recycling or disposal centers.

More particularly, the invention relates to the sector which manufactures and uses systems in which garbage which has been deposited through the appropriate openings accumulates in one or more containers which are located underneath these openings, awaiting removal to be sent their final destination.

Usually, in order to occupy less space, these containers are underground receptacles with a high capacity, but they may have limited usable space inasmuch as the garbage which piles up in the approximate shape of a pyramid reaches up to and blocks the aforementioned openings, preventing all the usable space from being filled.

Removal of this garbage therefore becomes difficult and complex, and consequently expensive.

Another reason why containers with higher capacity and usable space cannot be utilized is the fermentation and reproduction of bacteria which generate malodorous gas and vapors with high content of germs which adversely affect public health.

Consequently, for example in the large cities, these containers are undersized with respect to the requirements of the inhabitants, and must necessarily be emptied frequently, more often than once a day in some cases.

SUMMARY OF THE INVENTION

The inventor of this invention thought that it would be possible to avoid all the drawbacks cited above by devising systems with containers having a larger usable space in that it would not be limited by the aforementioned factors, because the garbage could be moved in a transverse direction with regard to the openings, thereby causing the garbage to occupy areas of a container which are relatively far from the area lying immediately below the corresponding openings, while keeping the non-recyclable garbage—defined as solid urban waste—at a temperature low enough to prevent the aforementioned fermentation and reproduction of germs and bacteria.

To do this, the object of this invention is to devise a system for collecting recyclable or non-recyclable garbage, as described in the preamble of the attached claim 1, with features which are described in the characterizing part of that same claim.

A more detailed description of a preferred embodiment of a system as claimed in the invention follows. This example shall not in any way be considered binding or restrictive of the scope of the invention, which includes all possible embodiments conceivable to one skilled in the art.

BRIEF DESCRIPTION OF THE INVENTION

Figure 1:
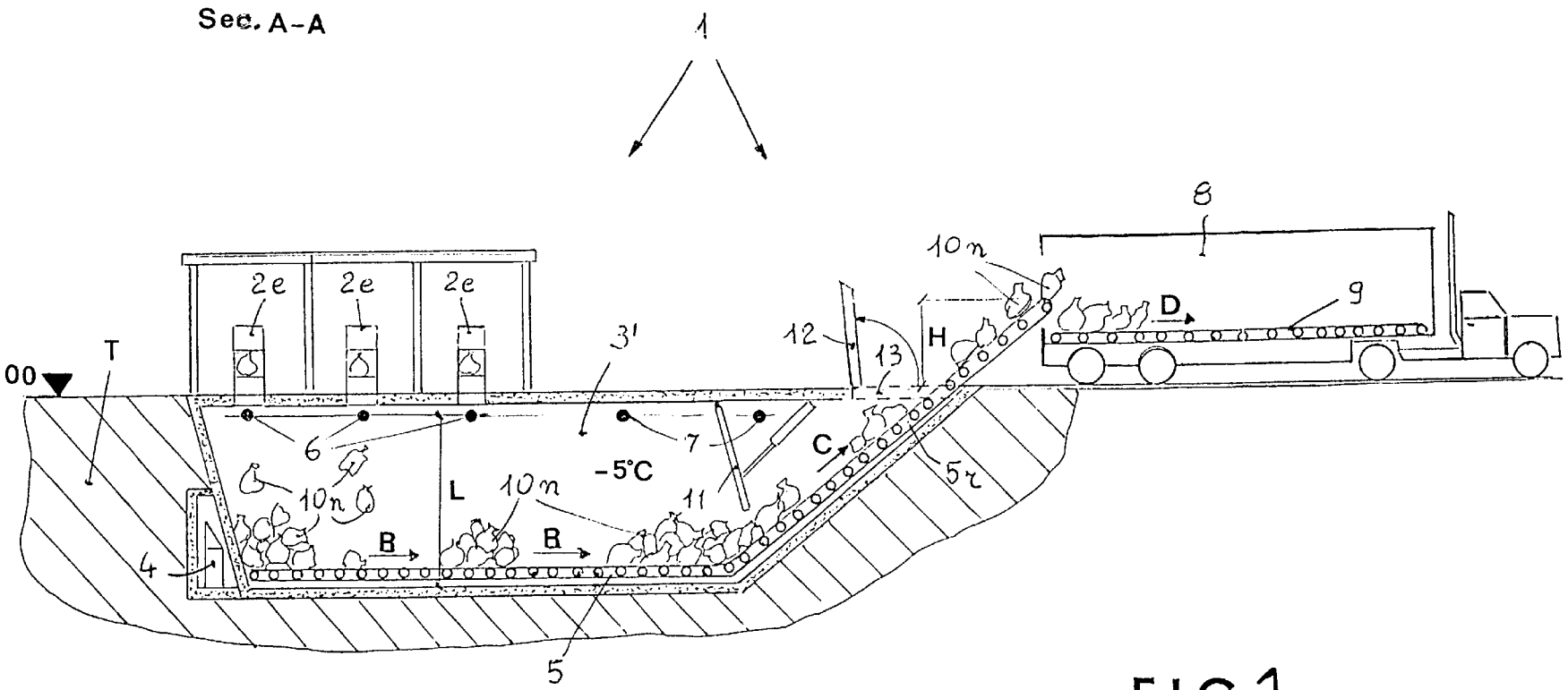
Figure 2:
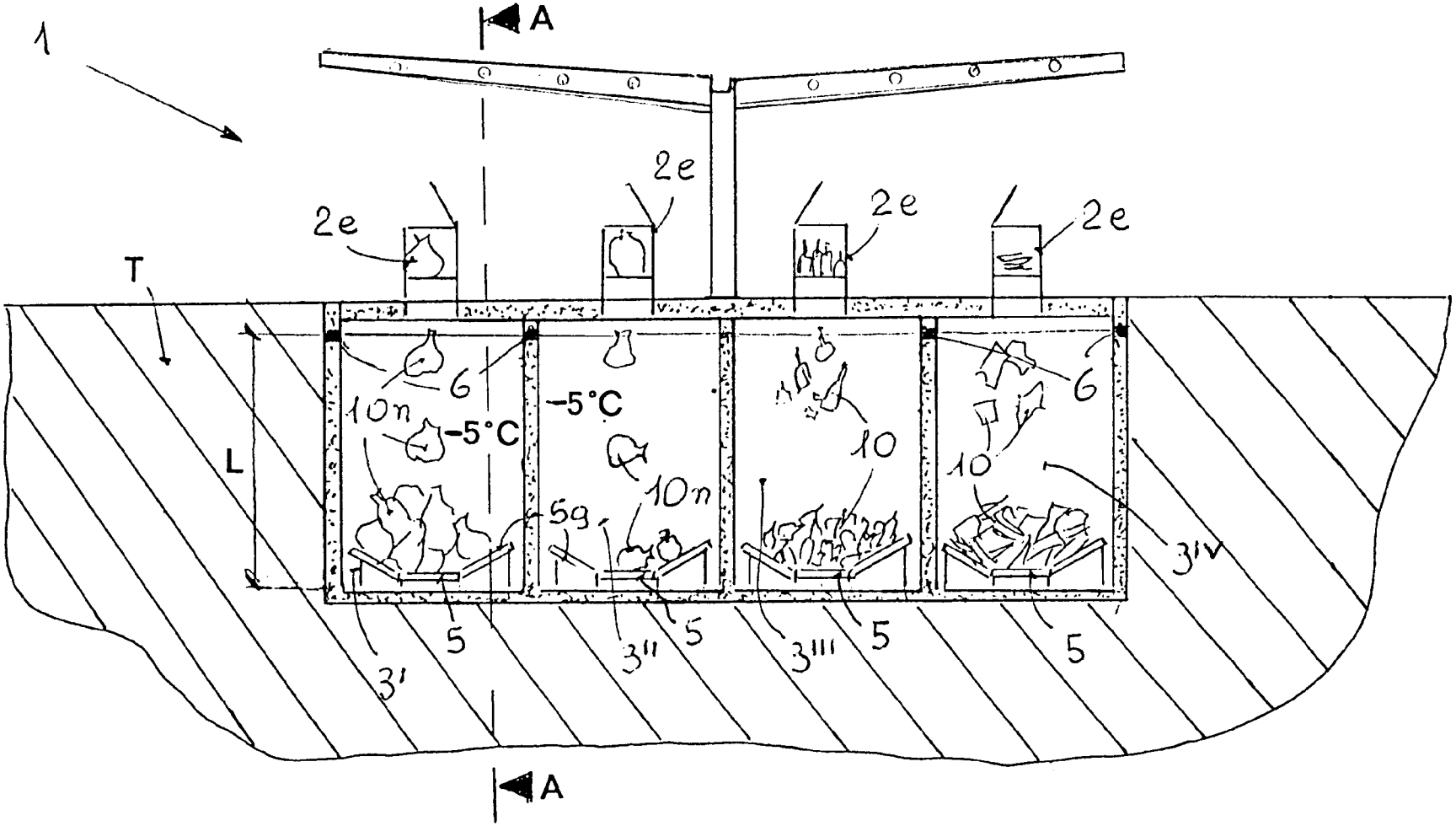

This description refers to the attached diagrams listed below:

FIG. 1 shows a longitudinal cross-section of said preferred embodiment of a system as claimed in the invention;

FIG. 2 shows a transverse cross-section. FIGS. 1 and 2 show that a system 1 as claimed in the invention can have a host of openings 2*e* side by side in a number of parallel rows.

DESCRIPTION OF THE PREFERRED EMBODIMENTS

The diagrams show four parallel rows, each comprised of three garbage openings 2*e* (which will henceforth be called simply "openings"): in fact, the system 1 has a total of twelve openings 2*e*.

For each of these parallel rows of openings 2*e* there is a container 3', 3", 3"', $3^{1V}$, buried, with a rectangular usable area, located below the openings, with openings 2*e* located at ground level T.

Of these four rows of openings 2*e*, the first two on the left in FIG. 2 are intended to hold non-recyclable garbage 10*n*, or solid urban waste, and the other two are intended to hold recyclable waste 10, such as for example, glass and cardboard, respectively.

At the bottom of each container 3', 3", 3"', $3^{1v}$ there are means for moving the garbage, comprised of conveyor belts 5 equipped preferably with lateral guides 5*g* inclined as shown in the figure, in order to accommodate the waste by pushing it towards the center of the respective container.

In each container there are means 6 using photocells or the like which indicate when garbage 10, 10*n* deposited in the corresponding container has reached a certain level L near the level of the openings 2*e*.

When this level has been reached, said means 6 actuate the conveyor belt 5 of the container in question, thereby transversely moving the line of garbage which has reached this level (arrow B, FIG. 1) in order to place it in an area of the container where no opening is located, and serves as a reservoir for accumulating said garbage 10, 10*n*.

There are other means 7, similar to those described above, which indicate when that area of the part of the container which acts as a garbage reservoir is completely full of piles of garbage 10, 10*n* which have reached said level L.

When this level has been reached, said means 7 which indicate the level of the garbage recognize that the container can hold no more, and with known methods block the mechanisms which allow the openings 2*e* to open, because no more garbage should be allowed to enter, and they emit and transmit to a control center a signal which identifies the situation of this full container.

The operators which direct this control center can then send a truck 8, and when the truck is positioned correctly, re-actuate the conveyor belt 5 which via a ramp 5*r* inclined upwards transports the garbage 10, 10*n* (arrow C, FIG. 1) out of the container which is in a position and a height H with respect to ground T which will allow loading on the loading platform of truck 8, a loading platform which preferably should itself be comprised of a conveyor belt 9, incorporated into the truck 8, so as to easily arrange the garbage (see arrow D) along the entire surface of the loading bay of said truck 8. When one of containers 3', 3", 3"', $3^{1v}$ has been entirely emptied, garbage can begin to be deposited in it again, and a new cycle begins which is repeated as illustrated.

The inventor intends the containers 3', 3" into which decaying organic waste which is capable of fermenting and developing bacteria is deposited to be equipped with a cooling system 4 which with known methods, for example with pipes distributed along the surfaces of said containers 3', 3" (not shown in the diagrams), will keep the temperature inside them sufficiently low (preferably less than or equal to −5° C.).

When the containers 3', 3" for non-recyclable garbage 10*n* are completely buried as shown in the figure, and therefore in almost all cases, properly insulating the surfaces of the upper horizontal walls of these containers and also the walls of the partition which divides it from containers 3''', 3$^{1v}$ for recyclable garbage, then the cooling system 4 will consume a minimum amount of power, with only a small impact on the management costs of system 1 built as claimed in the invention.

This system allows use of containers with a surface area and therefore capacity which is theoretically unlimited, as well as the possibility of removing non-recyclable waste without the need to intervene before it decomposes, inasmuch as the latter is not checked.

In conclusion, all the objects set by the inventor have been accomplished herein.

A system produced as claimed in the invention could naturally be equipped with means which could be actuated from the outside to prevent the garbage 10*n* from returning to within the container, as for example a hydraulically actuated retaining flap 11 (FIG. 1) which also serves to prevent exchange of heat between the cooled zone and the external environment. The opening 13 of the ramp 5*r* can also be closed with a lid 12 which, when it is closed, allows only the end of the load of said ramps 5*r* on the conveyor belts 5 to protrude outwards, in the case in which they are not of the flexible type or have smooth-running "disappearing" elements (not depicted in the figure), a type which the inventor suggests be used in order not to permanently occupy space in the surface area in addition to that strictly necessary for openings 2*e*.

The system as claimed in the invention can advantageously be controlled, monitored, and remotely actuated using a computer located in said control center (not shown due to its generic nature).

What is claimed is:

1. A garbage storage system, comprising:

a refrigerated underground storage area comprising plural refrigerated underground collection areas and an adjacent refrigerated underground reservoir with a ramp that leads up to an above-ground garbage removal location;

plural first conveyors, each of said first conveyors extending from a respective one of said collection areas to said reservoir;

at least one second conveyor that communicates with at least one of said first conveyors and that extends from said reservoir up said ramp and through a first opening to said above-ground garbage removal location; and plural second openings, each of said second openings providing access to a respective one of said collection areas and being above a respective one of said first conveyors, whereby garbage deposited through one of said second openings is conveyed by one of said first conveyors to said reservoir and subsequently is conveyed by said second conveyor through said first opening to said above-ground location.

2. The system of claim 1, further comprising level sensors in said collection areas for detecting respective garbage levels.

3. The system of claim 2, wherein said first conveyors operate in response to outputs from respective ones of said level sensors.

4. The system of claim 1, further comprising a level sensor in said reservoir for detecting a garbage level in said reservoir.

5. The system of claim 4, wherein said second openings are locked closed in response to an output from said level sensor.

6. The system of claim 4, wherein said second conveyor is operable from said above-ground location in response to a signal generated by said level sensor.

7. The system of claim 1, further comprising a door that closes said first opening.

8. The system of claim 1, further comprising a flap adjacent to said ramp that separates said refrigerated reservoir from said first opening.

9. The system of claim 1, further comprising a cooling system that maintains a temperature of said refrigerated underground storage area below 0° C.

10. The system of claim 1, wherein said first conveyors are parallel to each other and are at the same level as said second conveyor, said second conveyor extending serially from said first conveyors in the same direction as said first conveyors.

11. The system of claim 1, further comprising: first level sensors in said collection areas for detecting respective garbage levels, said first conveyors operating automatically in response to outputs from respective ones of said first level sensors;

a second level sensor in said reservoir for detecting a garbage level, said second openings being locked closed in response to an output from said second level sensor;

a door that closes said first opening;

a flap adjacent to said ramp that separates said refrigerated reservoir from said door; and a cooling system that maintains a temperature of said refrigerated underground storage area below 0° C.

12. The system of claim 11, wherein said first conveyors are parallel to each other and are at the same level as said second conveyor, said second conveyor extending serially from said first conveyors in the same direction as said first conveyors.

* * * * *

UNITED STATES PATENT AND TRADEMARK OFFICE

CERTIFICATE OF CORRECTION

PATENT NO. : 6,301,921 B1
DATED : October 16, 2001
INVENTOR(S) : Francesco Sampietro It is certified that error appears in the above-identified patent and that said Letters Patent is hereby corrected as shown below:

Title page,
Item [12], change inventor from "Francesco" to -- Sampietro --.

Signed and Sealed this

Twenty-first Day of May, 2002

*Attest:*

*Attesting Officer*

JAMES E. ROGAN
*Director of the United States Patent and Trademark Office*